US009828699B2

(12) United States Patent
de Palo et al.

(10) Patent No.: US 9,828,699 B2
(45) Date of Patent: Nov. 28, 2017

(54) POLYMER FILAMENT

(75) Inventors: Roberto de Palo, Ferrara (IT); Roberto Vanzini, Francolino (IT); Gianni Perdomi, Ferrara (IT); Andrea Felisati, Ferrara (IT)

(73) Assignee: Basell Poliolefine Italia S.r.l., Milan (IT)

( * ) Notice: Subject to any disclaimer, the term of this patent is extended or adjusted under 35 U.S.C. 154(b) by 935 days.

(21) Appl. No.: 13/496,457

(22) PCT Filed: Sep. 13, 2010

(86) PCT No.: PCT/EP2010/063394

§ 371 (c)(1),
(2), (4) Date: Mar. 15, 2012

(87) PCT Pub. No.: WO2011/032917

PCT Pub. Date: Mar. 24, 2011

(65) Prior Publication Data

US 2012/0171393 A1 Jul. 5, 2012

Related U.S. Application Data

(60) Provisional application No. 61/277,290, filed on Sep. 23, 2009.

(30) Foreign Application Priority Data

Sep. 21, 2009 (EP) ..... 09170859
Sep. 6, 2010 (EP) ..... 10175458

(51) Int. Cl.

| | |
|---|---|
| ***D01F 6/46*** | (2006.01) |
| ***D01D 5/42*** | (2006.01) |
| ***D06N 7/00*** | (2006.01) |
| ***E01C 13/08*** | (2006.01) |

(52) U.S. Cl.

CPC ..... *D01F 6/46* (2013.01); *D01D 5/42* (2013.01); *D06N 7/0065* (2013.01); *E01C 13/08* (2013.01)

(58) Field of Classification Search

CPC ..... C08L 23/16; C08L 23/20; C08L 23/10; C08L 2666/06; C08L 23/14; C08L 23/18; C08L 2205/035; C08L 51/06; C08L 23/06; C08L 23/12; C08L 2314/06; C08L 2205/02; C08L 23/142; C08L 2308/00; C08F 10/08; C08F 4/42; C08F 297/08; C08F 4/65912; C08F 110/08; C08F 210/08; C08F 10/00; C08F 210/06; C08F 210/16; C08F 110/06; C08F 10/06; C08F 4/64; C08F 8/00; C08F 4/6592; C08F 4/659; C08F 4/44; C08F 4/65916; C08F 297/083; D06N 7/0036; D06N 7/0065; D06N 7/0063; E01C 13/08; D02G 3/445; D04H 3/16; D04H 3/14; D01F 6/46; D01D 5/42; C09J 123/06; C09J 123/18; A41G 1/00; A41G 1/009; D10B 2505/202; D05C 17/02; C07F 7/08; C07F 7/22; C07F 7/30; C07F 7/12; C07F 17/00; C07F 7/00; C07F 7/0827; C07F 7/0818; C07F 7/2212; D04B 21/04; D04B 1/04; B32B 5/02; B32B 7/12; B32B 27/32; B01J 31/22; B01J 31/00; B01J 2531/48; B01J 21/08; B01J 31/1616; B01J 31/1608; B01J 31/2295; B01J 31/143

USPC ..... 428/359, 98, 36.9, 92, 397, 95, 97, 17, 428/373, 500; 264/146, 289.3, 210.6, 264/210.8; 524/528, 430, 432, 537, 539, 524/599, 605; 525/240, 247; 526/125.8, 526/348.6, 128, 127, 348.2, 160, 65, 159, 526/351, 348.5, 114, 348, 113, 348.1, 526/118, 119

See application file for complete search history.

(56) References Cited

U.S. PATENT DOCUMENTS

| | | | | |
|---|---|---|---|---|
| 4,399,054 | A | 8/1983 | Ferraris | |
| 4,472,524 | A | 9/1984 | Albizzati | |
| 5,145,819 | A | 9/1992 | Winter | |
| 5,324,800 | A | 6/1994 | Welborn, Jr. | |
| 5,552,482 | A * | 9/1996 | Berta | C08L 23/12 525/193 |
| 6,342,565 | B1 * | 1/2002 | Cheng | C08L 23/10 525/191 |
| 6,492,465 | B1 * | 12/2002 | Burkhardt et al. | 525/247 |

(Continued)

FOREIGN PATENT DOCUMENTS

| | | |
|---|---|---|
| EP | 0045977 | 8/1981 |
| EP | 0129368 | 12/1984 |

(Continued)

OTHER PUBLICATIONS

Chujo, R et al., "Two-site model analysis of 13C n.m.r. of polypropylene polmerized by . . . ", Polymer, vol. 35, No. 2 1994 , 339.
Asakura, et al., "Carbon-13 NMR Spectral Assignment . . . ", Macromolecules 1991, 24 1991 , 2334-2340.
Randall, J. , "A Review of High Resolution Liquid (13) Carbon Nuclear Magnetic Resonance Characterizations of Ethylene-Based Polymers", JMS-Rev. Macromol. Chem. Phys. C29 (2&3) 1989 , 201-317.

(Continued)

*Primary Examiner* — Scott R Walshon

(57) ABSTRACT

A polymer filament comprising a polyolefin composition which comprises at least 10% by weight of one or more copolymer(s) (I) of propylene with one or more comonomers selected from ethylene, $C_4$-$C_{10}$ α-olefins and their combinations, said copolymer or copolymers (I) having MFR from 0.5 to 10 g/10 min. and containing units deriving from the said comonomers in a total amount of from 0.5 to 25% by weight with respect to the total amount of all momoner units in the copolymer, provided that, in the absence of comonomer units deriving from $C_6$-$C_{10}$ α-olefins, the amount of comonomer units deriving from ethylene or $C_4$-$C_5$ α-olefins or their combinations is at least 2.5% by weight.

8 Claims, No Drawings

(56) References Cited

U.S. PATENT DOCUMENTS

| | | | | |
|---|---|---|---|---|
| 2004/0013870 | A1 | 1/2004 | Sheldon et al. | |
| 2005/0165173 | A1 | 7/2005 | Autran et al. | |
| 2006/0020096 | A1 | 1/2006 | Schottek et al. | |
| 2006/0258811 | A1* | 11/2006 | Barcus et al. | 525/240 |
| 2007/0173162 | A1 | 7/2007 | Ethiopia et al. | |
| 2008/0275180 | A1 | 11/2008 | Musgrave | |
| 2009/0155614 | A1* | 6/2009 | McLeod | B32B 27/32 428/516 |
| 2009/0326156 | A1* | 12/2009 | Pellegatti et al. | 525/240 |
| 2010/0009100 | A1* | 1/2010 | Van Reijen | 428/17 |

FOREIGN PATENT DOCUMENTS

| | | |
|---|---|---|
| EP | 400333 | 12/1990 |
| EP | 472946 | 3/1992 |
| EP | 485823 | 5/1992 |
| EP | 1279699 A1 * | 1/2003 |
| EP | 1378592 | 1/2004 |
| WO | WO-9840419 | 9/1998 |
| WO | WO-03011962 | 2/2003 |
| WO | WO-2004099269 | 11/2004 |
| WO | WO-2005005730 | 1/2005 |
| WO | WO-2006042815 | 4/2006 |
| WO | WO-2009000637 | 12/2008 |

OTHER PUBLICATIONS

Cheng, H. N. et al., "13C NMR Analysis of Propylene-Butylene Copolymers by a Reaction Probability Model", Journal of Polymer Science, vol. 21. 1983 , 573-581.

Kakugo, Masahiro et al., "C NMR Determination of Monomer Sequence Distribution in Ethylene-Propylene copolymers prepared . . . ", Macromolecules, vol. 15, No, 4, 1982 , 1150-1152.

Carman, C.J. et al., Macromolecules, 10, 3, 536 1977.

* cited by examiner

POLYMER FILAMENT

This application is the U.S. national phase of International Application PCT/EP2010/063394, filed Sep. 13, 2010, claiming priority to European Application 09170859.4 filed Sep. 21, 2009, and European Application 10175458.8 filed Sep. 6, 2010, and the benefit under 35 U.S.C. 119(e) of U.S. Provisional Application No. 61/277,290, filed Sep. 23, 2009; the disclosures of International Application PCT/EP2010/063394, European Application 09170859.4, European Application 10175458.8 and U.S. Provisional Application No. 61/277,290, each as filed, are incorporated herein by reference.

The present invention concerns a polymer filament, in particular a polyolefin filament particularly suited for producing artificial turf.

The term "filament" is used in the definition of the present invention to make a distinction with respect to the fibers normally used for textile and carpeting applications. In fact it is known, as explained for example in WO2005/005730, that strands with heavy denier, often called "filaments", are required to prepare artificial turf structures. Thus the filaments according to the invention, also called, for the said reasons, "artificial turf filaments", are preferably characterized by a titre of at least 20 dTex. To produce the final artificial turf structure, the filaments are normally fixed to a backing substrate.

The so obtained artificial turf is primarily used to substitute natural grass, in particular in sport fields.

As explained in EP1378592, US2004/0013870 and US2006/0258811, for such applications as well as for other applications of artificial turf filaments, important and highly desirable properties are the resistance to tear, in particular to longitudinal splitting, and a high tensile elongation.

The polyolefin materials described in the above said prior art literature comprise a propylene homopolymer and in alternative, according to EP1378592, a generically defined propylene copolymer, and elastomeric/plastomeric polymer materials.

It has now been found that by selecting, as polypropylene component, a specific class of propylene copolymers, very high values of tear resistance and elongation at break are obtained, in combination with other valuable properties, such as a high stress at break and relatively low tangent modulus. The low tangent modulus values are a measure of good flexibility and softness. All these properties are highly valuable in artificial turf applications.

Moreover, filaments according to the present invention, having the said heavy denier and preferred titre, can be advantageously used in fields different from artificial turf, like civil engineering and packaging, due to their high creep resistance.

Thus the present invention provides a polymer filament comprising a polyolefin composition which comprises at least 10% by weight, preferably at least 55% by weight, more preferably at least 65% by weight of one or more copolymer(s) (I) of propylene with one or more comonomers selected from ethylene, $C_4$-$C_{10}$ α-olefins and their combinations, said copolymer or copolymers (I) having a MFR (Melt Flow Rate) from 0.5 to 10 g/10 min. and containing units deriving from the said comonomers in a total amount of from 0.5 to 25% by weight, preferably from 1.5 to 20% by weight or from 1.5 to 15% by weight, more preferably from 2.5 to 20% by weight or from 2.5 to 15% by weight with respect to the total amount of all momoner units (comprising both propylene and the said comonomer units) in the copolymer, provided that, in the absence of comonomer units deriving from $C_6$-$C_{10}$ α-olefins, the amount of comonomer units deriving from ethylene or $C_4$-$C_5$ α-olefins or their combinations is at least 2.5% by weight.

Additional preferred features for the copolymer or copolymers (I) are:

- melting temperature equal to or higher than 100° C., in particular equal to or higher than 120° C., measured with differential scanning calorimetry (DSC);
- a polymer fraction insoluble in xylene at room temperature (about 25° C.) equal to or lower than 90% by weight, in particular from 90 to 60% by weight.

While 100% of the polyolefin composition in the filament of the present invention can be substantially made of copolymer or copolymers (I) as defined above, in a preferred embodiment the polyolefin composition of the filament of the present invention comprises:

A) 55%-95% by weight, preferably 65%-85% by weight of one or more copolymer(s) (I) as defined above; and B) 5-45% by weight, preferably 15-35% by weight of an elastomeric or plastomeric polyolefin or polyolefin composition.

In addition to or in alternative to B), it is possible to use other polyolefin materials commonly known in the art to be useful in the production of polyolefin filaments, in particular artificial turf filaments, like for instance high density ethylene polymers (particularly homopolymers) or low or very low density ethylene copolymers.

Another preferred embodiment of the present invention is constituted by a polymer filament comprising a polyolefin composition which comprises:

A) 10%-95% by weight of one or more copolymer(s) (I) as defined above; and $B^I$) 5-90% by weight by weight of a butene-1 homopolymer or copolymer having a flexural modulus of 80 MPa or higher, in particular of 250 MPa or higher.

Such filament, as will be shown in the examples, has advantageously high levels of creep resistance.

The artificial turf filaments and more generally all the filaments according to the present invention are also typically characterized by a rounded (circular, oval or even more complex, like multilobal) cross-section, or by an angular, like rectangular, cross-section.

The filaments having rounded cross-section are also called "monofilaments" while those having angular and in particular rectangular cross-section are also called "tapes". Thus the definition of "filament" according to the present invention comprises the said monofilaments and tapes.

Preferably the tapes have a thickness from 0.03 to 1 mm and width from 2 to 20 mm.

As previously said, the filaments of the present invention are preferably characterized by a titre of at least 20 dTex Particularly preferred titre values for the filaments of the present invention are of at least 50 dTex, especially of at least 100 or 200, in particular of at least 500 dTex, the upper limit being preferably of 1000 dTex for monofilaments and of 25000 dTex for tapes.

The filament according to the present invention is preferably stretched by drawing. Particularly preferred are draw ratios from 1.5 to 10, in particular from 3 to 10.

All the said filaments can be used in the form of bundles for preparation of the artificial turf structures. The number of individual filaments in a single bundle is preferably up to 20.

Filaments made of different polymer materials, like for instance polyethylene or polyamide, can be present in the bundles.

The bundles can be held together by one or more wrapping filaments, generally of polymer materials, like polypropylene or polyethylene, such wrapping filaments being preferably bonded to one another and/or with the bundled filaments of the present invention.

Another way of obtaining bundles of filaments is by fibrillation of tapes having relatively large width.

Moreover the filaments can comprise components made of materials different from polyolefins, like embedded reinforcing fibers, made for example of polyamide.

From the above definitions of propylene copolymer(s) (I) it is evident that the term "copolymer" includes polymers containing more than one kind of comonomers.

The $C_4$-$C_{10}$ α-olefins, as well as all the α-olefins hereinafter reported as comonomers in olefin copolymers, are selected from olefins having formula $CH_2{=}CHR$ wherein R is an alkyl radical, linear or branched, or an aryl radical, having the appropriate number of carbon atoms; thus, for instance, from 1 to 8 carbon atoms for $C_3$-$C_{10}$ α-olefins, or from 2 to 8 carbon atoms for $C_4$-$C_{10}$ α-olefins.

Specific examples of $C_3$-$C_{10}$ α-olefins are propylene, butene-1, pentene-1,4-methylpentene-1, hexene-1 and octene-1. The preferred comonomers in the propylene copolymer or copolymers (I) are ethylene, butene-1 and hexene-1.

The propylene copolymer or copolymers (I) can be prepared by using a Ziegler-Natta catalyst or a metallocene-based catalyst system in the polymerization process.

The said catalysts and the polymerization processes are known in the art.

Conventional molecular weight regulators known in the art, such as chain transfer agents (e.g. hydrogen or $ZnEt_2$), may be used.

Preferred examples of Ziegler-Natta catalysts are the supported catalyst systems comprising a trialkylaluminium compound, optionally an electron donor, and a solid catalyst component comprising a halide or halogen-alcoholate of Ti and optionally an electron-donor compound supported on anhydrous magnesium chloride. Catalysts having the above-mentioned characteristics and polymerization processes employing such catalysts are well known in the patent literature; particularly advantageous are the catalysts and polymerization processes described in U.S. Pat. No. 4,399,054 and EP-A-45 977. Other examples can be found in U.S. Pat. No. 4,472,524.

Preferred examples of metallocene-based catalyst systems are disclosed in US2006/0020096 and WO98/040419.

The polymerization conditions in general do not need to be different from those used with Ziegler-Natta catalysts.

The elastomeric or plastomeric polyolefin or polyolefin composition B) that can be used in the filament of the present invention can be any elastomeric or plastomeric polymer or polymer composition commonly used to modify the mechanical properties of polyolefins.

The term "plastomeric" in the definition of the present invention is used to include the particular class of materials having properties intermediate to those of thermoplastic and elastomeric materials, generally called "plastomers". Said polyolefin plastomers can have a broad range of densities (up to about 0.90 g/cm$^3$) and a higher crystallinity than the traditional elastomers.

Be it an elastomeric or plastomeric material, the said component B) typically has at least one of the following features:

- Flexural modulus (ISO 178A) equal to or less than 200 MPa, preferably equal to or less than 170 MPa, most preferably equal to or less than 100 MPa;
- Shore D hardness equal to or less than 50 points, more preferably equal to or less than 45 points and most preferably equal to or less than 40 points;
- Shore A hardness equal to or less than 90 points;
- X-ray crystallinity from 0 to 40%, preferably from 0 to 30%.

Preferred examples of B) are heterophasic polyolefin compositions comprising (i) one or more crystalline propylene homopolymer(s) or copolymer(s) of propylene with up to 10% by weight of ethylene and/or other α-olefin comonomer(s), or combinations of said homopolymers and copolymers, and (ii) a copolymer or a composition of copolymers of ethylene with other α-olefins and optionally with minor amounts of a diene (typically from 1 to 10% with respect to the weight of (ii)), containing 15% or more, in particular from 15% to 90%, preferably from 15 to 85% of ethylene.

Preferred amounts of said components (i) and (ii) in B) are from 5 to 60% by weight, more preferably from 10 to 50% by weight of (i) and from 40 to 95% by weight, more preferably from 50 to 90% by weight of (ii), referred to total weight of (i) and (ii).

In particular, the said α-olefin comonomers in the said heterophasic compositions are selected from $C_4$-$C_{10}$ α-olefins for component (i) and $C_3$-$C_{10}$ α-olefins for component (ii).

The heterophasic compositions particularly useful as component B) typically have a MFR ranging from 0.1 to 50 g/10 minutes, preferably from 0.5 to 20 g/10 minutes.

Particular and preferred examples of B) are the heterophasic polyolefin compositions (II) comprising (weight percentages):

i) 5-60%, preferably 10-50% of one or more propylene homopolymer(s) insoluble in xylene at room temperature in an amount of more that 80%, in particular from 85 to 99%, or one or more copolymer(s) of propylene with ethylene and/or $C_4$-$C_{10}$ α-olefin(s), containing 90% or more of propylene, and being insoluble in xylene at room temperature in an amount of more that 80%, in particular from 85 to 95%, or combinations of said homopolymers and copolymers;

ii) 40-95%, preferably 50-90% of a fraction of one or more copolymer(s) of ethylene with propylene and/or $C_4$-$C_{10}$ α-olefin(s), and optionally minor quantities of a diene, said copolymer(s) containing from 15 to 45%, preferably from 18 to 40% of ethylene, and having solubility in xylene at ambient temperature of 50% by weight or greater, preferably of 70% by weight or greater.

The preferred comonomer in the propylene copolymers of component (i) is ethylene.

The preferred comonomer in the propylene copolymers of fraction (ii) is propylene.

When present, the diene in the heterophasic composition B) preferably ranges from 1 to 10%, more preferably 2.5-7% by weight with respect to the total weight of fraction (ii). Examples of dienes are butadiene, 1,4-hexadiene, 1,5-hexadiene, and 5-ethylidene-2-norbornene.

The said heterophasic compositions can be prepared by blending components (i) and (ii) in the molten state, that is to say at temperatures greater than their softening or melting point, or more preferably by sequential polymerization in the presence of a Ziegler-Natta catalyst as previously defined.

Other catalysts that may be used are metallocene-type catalysts, as described in U.S. Pat. No. 5,324,800 and EP-A-0 129 368; particularly advantageous are bridged bis-indenyl metallocenes, for instance as described in U.S. Pat. No. 5,145,819 and EP-A-0 485 823.

These metallocene catalysts may be used in particular to produce the fraction (ii).

The above mentioned sequential polymerization process for the production of the heterophasic composition comprises at least two stages, where in one or more stage(s) propylene is polymerized, optionally in the presence of the said comonomer(s), to form component (i), and in one or more additional stage(s) mixtures of ethylene with said $C_3$-$C_{10}$ alpha-olefin(s), and optionally diene, are polymerized to form fraction (ii).

The polymerization processes are carried out in liquid, gaseous, or liquid/gas phase. The reaction temperature in the various stages of polymerization can be equal or different, and generally ranges from 40 to 90° C., preferably from 50 to 80° C. for the production of component (i), and from 40 to 60° C. for the production of (ii).

Examples of sequential polymerization processes are described in European patent applications EP-A-472946 and EP-A-400333 and in WO003/011962.

Other preferred examples of B) are:

1) butene-1 (co)polymers having:
   - a content of butene-1 derived units of 80% by weight or more;
   - flexural modulus of 60 MPa or less;
2) propylene copolymers containing up to 40% by weight of an olefin comonomer, preferably ethylene or a $C_4$-$C_{10}$ α-olefin, and having Shore A hardness of 90 points or less;
3) ethylene copolymers containing up to 45% by weight, in particular from 10 to 40% by weight, of an olefin comonomer, preferably a $C_3$-$C_{10}$ α-olefin, in particular butene-1 or octene-1, and having Shore A hardness of 90 points or less.

The term "butene-1 (co)polymers" as used herein refers to butene-1 homopolymers, copolymers with α-olefins and compositions thereof, having from elastomeric to plastomeric behaviour. The butene-1 (co)polymers 1) exhibit low flexural modulus and preferably low crystallinity (less than 40% measured via X-ray, preferably less than 30).

Preferred α-olefins which are or may be present as comonomers in the butene-1 (co)polymers 1) are selected from ethylene, propylene and $C_5$-$C_8$ α-olefins. Particularly preferred as comonomers are propylene and ethylene.

Preferred values of MFR for the butene-1 (co)polymers 1) are from 0.5 to 50 g/10 min.

Such (co)polymers are known in the art and can be obtained by polymerization in the presence of Ziegler-Natta catalysts, as disclosed for instance in WO2006/042815, or metallocene catalysts, as disclosed for instance in WO2004/099269 and in WO2009/000637.

The polymers produced according to the teaching of said WO2006/042815 typically have a percent of isotactic pentads (mmmm) from 25 to 56%.

Preferred examples of propylene copolymers 2) are the propylene copolymers containing from 0.1 to 40% by weight, more preferably from 0.1 to 25% by weight of olefin comonomers, in particular ethylene.

The said propylene copolymers have typically a density from 0.850 to 0.890 g/cm$^3$, in particular from 0.855 to 0.885 g/cm$^3$. They generally display no or relatively low degree of crystallinity, indicatively from 0 to 25% when measured as X-ray crystallinity.

Other typical properties of propylene copolymers 2) are:

- Shore A hardness equal to or less than 90 points, preferably equal to or less than 88 points, more preferably equal to or less than 75 points;
- melting point, measured with differential scanning calorimetry (DSC) at a heating/cooling rate of 10-20° C., of 105° C. or less, preferably of 90° C. or less;
- heat of fusion, measured with DSC under the said conditions, of 75 J/g or less;
- molecular weight distribution, in terms of Mw/Mn (Mw=weight average molecular weight and Mn=number average molecular weight, both measured by gel permeation chromatography in trichlorobenzene at 135° C.) from 1.5 to 5.

Suitable propylene copolymers 2) are the plastomers Vistamaxx® and Versify® made available on the market by ExxonMobil Chemical and Dow Chemical.

Suitable ethylene copolymers 3) are the plastomers Exact® and Engage® made available on the market by ExxonMobil Chemical and Dow Chemical.

The homo- or copolymers $B^I$) of butene-1 are well known in the art, particularly for their good properties in terms of pressure resistance and creep resistance.

Suited homoplymers $B^I$) of butene-1 are linear, semicrystalline, higly isotactic homopolymers (having in particular an isotacticity from 96 to 99%, measured both as mmmm pentads/total pentads using NMR, and as quantity by weight of matter soluble in xylene at 0° C.).

Suitable copolymers $B^I$) of butene-1 are the copolymers preferably containing up to 20% by weight, in particular up to 15% by weight of comonomer(s). The comonomers in copolymer $B^I$) are in particular olefinic comonomers, preferably selected from ethylene, propylene and $CH_2$=CHR α-olefins where R is a $C_3$-$C_6$ alkyl radical. Examples of the said $CH_2$=CHR α-olefins are 4-methyl-1-pentene, octene-1. Most preferred comonomers in the copolymer b) are ethylene and propylene.

All these homo- or copolymers of butene-1 can be obtained with polymerization processes and catalysts well known in the art, like low-pressure Ziegler-Natta polymerization of butene-1, for example by polymerizing butene-1 (and any comonomers) with catalysts based on $TiCl_3$, or supported catalysts systems of the same kind as described above for the preparation of the copolymer (I).

Other preferred features of the homo- or copolymers $B^I$) are:

- a flexural modulus from 80 to 600 MPa, in particular form 250 to 600 MPa;
- MFR measured according to ISO 1133 at 190° C., 2.16 kg, of 0.5-20 g/10 min., in particular 0.5-10 g/10 min.;
- a melting point Tm(II) of crystalline form 2 (the first to form, being favoured kinetically) from 81 to 115° C., measured according to ISO 11357 Part 3.

The polyolefin compositions that can be used for preparing the filament of the present invention (for instance the compositions containing the previously defined components A) and B) or $B^I$)) are obtainable by melting and mixing the components, and the mixing is effected in a mixing apparatus at temperatures generally of from 180 to 310° C., preferably from 190 to 280° C., more preferably from 200 to 250° C.

Any known apparatus and technology can be used for this purpose.

Useful melt-mixing apparatus in this context are in particular extruders or kneaders, and particular preference is given to twin-screw extruders. It is also possible to premix the components at room temperature in a mixing apparatus.

During the preparation of the polyolefin compositions, besides the main components A) and B) or $B^I$) and other optional polymer components, it is possible to introduce additives commonly employed in the art, such as stabilizing agents (against heat, light, U.V.), plasticizers, antiacids, antistatic and water repellant agents, pigments.

The polyolefin filament of the invention can be prepared by means of processes and apparatuses well known in the relevant art.

In general terms, the process for preparing polyolefin filaments according to the invention comprises the following steps:

(a) melting the copolymer or copolymers (I) and the other polyolefin components, when present;

(b) spinning the filaments or extruding a precursor film or tape;

(c) optionally drawing the filaments or the precursor film or tape and/or cutting the precursor film or tape and optionally drawing the so obtained filaments, when no drawing is previously carried out;

(d) optionally finishing the filaments obtained from step (b) or by cutting the precursor film or tape in step (c).

The melting step (a) and the spinning or extrusion step (b) are generally carried out continuously in sequence by using mono- or preferably twin-screw extruders, equipped with a suited spinning or extrusion head. Thus also the previously described melt-mixing step can be carried out in the same spinning or extrusion apparatus used in step (b).

The spinning heads comprise a plurality of holes with the same shape as the transversal section of the filament (monofilament or tape).

The film extrusion heads are generally flat or annular dies commonly used for the film preparation.

When a precursor film or tape is obtained in step (b), it is then processed in step (c) by cutting it into tapes having the desired size. When the drawing treatment is carried out on the precursor film or tape, it is consequently no longer required on the final filament.

Examples of finishing treatments can be fibrillation and crimping.

Fibrillation is generally carried out on tapes.

Typically the melting step (a) and the spinning or extrusion step (b) are carried out at the same temperatures as previously defined for the melt-mixing step, namely of from 180 to 310° C., preferably from 190 to 280° C., more preferably from 200 to 250° C.

Typical spinning conditions are:

value of output per hole from 5 to 15 g/min;

pressure in the extruder from 10 to 40 bar;

temperature in the extruder head from 200 to 300° C.;

take-up speed from 200 to 1000 m/min.

Typical film extrusion conditions are:

output value from 50 to 1000 kg/hour (on industrial plants);

pressure in the extruder from 100 to 200 bar.

The filament or the precursor film obtained in step (b) are generally cooled by using for instance one or more chill rolls or by immersion in water at a temperature from 5 to 25° C.

To carry out the drawing treatment, the filament (monofilament or tape) or the precursor tape are previously heated at a temperature from 40 to 120-140° C. Heating can be achieved by using for example heated rolls or by irradiation or other known means.

Drawing can be achieved by delivering the filament or the precursor tape through a series of rolls having different rotation speeds. Preferred ranges of draw ratios so achieved are those previously specified.

Fibrillation can be achieved by feeding the tape between rolls having means for cutting longitudinally and/or diagonally.

As previously mentioned, the artificial turf is generally obtained by fixing the filaments or the said bundles of filaments to a substrate, generally called "backing".

Such backing can be for instance a polyolefin (in particular polypropylene) fiber mat.

Filling materials like sand and rubber particles, can be deposited over the backing.

The following examples are given for illustrating but not limiting purposes.

The following analytical methods are used to determine the properties reported in the description and in the examples.

Melt Flow Rate (MFR): ISO 1133 with a load of 2.16 kg at 230° C. for propylene polymers, or with a load of 2.16 kg at 190° C. for butene-1 polymers;

Density: ISO 1183;

Flexural Modulus: ISO 178 on rectangular specimens 80×10×4 mm from T-bars ISO527-1 Type 1A;

Hardness Shore A/D: ISO 868.

Tear resistance

A LLOYDS LRX dynamometer is used, with the following settings.

distance between clamps of 50 mm;

test speed 50 mm/min.

Strips with 10 cm width are cut from the extruded and drawn tape. From the strips test pieces having width in the middle of 12.7 mm are obtained. The middle portion is fixed to the upper clamp, while the two ends are fixed to the lower clamp.

The force required to tear the test piece along 50 mm is determined.

Stress at Yield and at Break, Elongation at Yield and at Break and Tangent modulus 0-10 MPa Measured on precursor tapes according to ASTM D882-02, using a dynamometer INSTRON 4301, under the following conditions:

test temperature of 25° C.;

cross head speed of 500 mm/min., independently of the specimen elongation at break;

distance between clamps of 50 mm.

Comonomer(s) Content

Determined by IR spectroscopy or by $^{13}$C-NMR (when specified).

$^{13}$C-NMR measurements are performed on a polymer solution (8-12% by weight) in dideuterated 1,1,2,2-tetrachloro-ethane at 120° C. The $^{13}$C NMR spectra are acquired on a Bruker AV-600 spectrometer operating at 150.91 MHz in the Fourier transform mode at 120° C. using a 90° pulse, 15 seconds of delay between pulses and CPD (WALTZ16) to remove $^{1}$H-$^{13}$C coupling. About 1500 transients are stored in 32K data points using a spectral window of 60 ppm (0-60 ppm).

Copolymer Composition

Diad distribution is calculated from $^{13}$C NMR spectra using the following relations:

$$PP=100\ I_1/\Sigma$$

$$PB=100 I_2/\Sigma$$

$$BB=100(I_3-I_{19})/\Sigma$$

$$PE=100(I_5+I_6)/\Sigma$$

$$BE=100(I_9+I_{10})/\Sigma$$

$$EE=100(0.5(I_{15}+I_6+I_{10})+0.25(I_{14}))/\Sigma$$

Where $\Sigma=I_1+I_2+I_3-I_{19}+I_5+I_6+I_9+I_{10}+0.5(I_{15}+I_6+I_{10})+0.25\ (I_{14})$ The molar content is obtained from diads using the following relations:

$$P(m\ \%)=PP+0.5(PE+PB)$$

$$B(m\ \%)=BB+0.5(BE+PB)$$

$$E(m\ \%)=EE+0.5(PE+BE)$$

$I_1$, $I_2$, $I_3$, $I_5$, $I_6$, $I_9$, $I_6$, $I_{10}$, $I_{14}$, $I_{15}$, $I_{19}$ are integrals of the peaks in the $^{13}C$ NMR spectrum (peak of EEE sequence at 29.9 ppm as reference). The assignments of these peaks are made according to J. C. Randal, *Macromol. Chem Phys.*, C29, 201 (1989), M. Kakugo, Y. Naito, K. Mizunuma and T. Miyatake, *Macromolecules,* 15, 1150, (1982), and H. N. Cheng, *Journal of Polymer Science, Polymer Physics Edition,* 21, 57 (1983). They are collected in Table A (nomenclature according to C. J. Carman, R. A. Harrington and C. E. Wilkes, *Macromolecules,* 10, 536 (1977)).

TABLE A

| I | Chemical Shift (ppm) | Carbon | Sequence |
|---|---|---|---|
| 1 | 47.34-45.60 | $S_{\alpha\alpha}$ | PP |
| 2 | 44.07-42.15 | $S_{\alpha\alpha}$ | PB |
| 3 | 40.10-39.12 | $S_{\alpha\alpha}$ | BB |
| 4 | 39.59 | $T_{\delta\delta}$ | EBE |
| 5 | 38.66-37.66 | $S_{\alpha\gamma}$ | PEP |
| 6 | 37.66-37.32 | $S_{\alpha\delta}$ | PEE |
| 7 | 37.24 | $T_{\beta\delta}$ | BBE |
| 8 | 35.22-34.85 | $T_{\beta\beta}$ | XBX |
| 9 | 34.85-34.49 | $S_{\alpha\gamma}$ | BBE |
| 10 | 34.49-34.00 | $S_{\alpha\delta}$ | BEE |
| 11 | 33.17 | $T_{\delta\delta}$ | EPE |
| 12 | 30.91-30.82 | $T_{\beta\delta}$ | XPE |
| 13 | 30.78-30.62 | $S_{\gamma\gamma}$ | XEEX |
| 14 | 30.52-30.14 | $S_{\gamma\delta}$ | XEEE |
| 15 | 29.87 | $S_{\delta\delta}$ | EEE |
| 16 | 28.76 | $T_{\beta\beta}$ | XPX |
| 17 | 28.28-27.54 | $2B_2$ | XBX |
| 18 | 27.54-26.81 | $S_{\beta\delta} + 2B_2$ | BE, PE, BBE |
| 19 | 26.67 | $2B_2$ | EBE |
| 20 | 24.64-24.14 | $S_{\beta\beta}$ | XEX |
| 21 | 21.80-19.50 | $CH_3$ | P |
| 22 | 11.01-10.79 | $CH_3$ | B |

Determination of Isotactic Pentads Content 50 mg of each sample were dissolved in 0.5 mL of $C_2D_2Cl_4$.

The $^{13}C$ NMR spectra were acquired on a Bruker DPX-400 (100.61 Mhz, 90° pulse, 12 s delay between pulses). About 3000 transients were stored for each spectrum; mmmm pentad peak (27.73 ppm) was used as reference.

The microstructure analysis was carried out as described in literature (Macromolecules 1991, 24, 2334-2340, by Asakura T. et Al. and Polymer, 1994, 35, 339, by Chujo R. et Al.).

The % value of pentad tacticity (mmmm %) so measured is the percentage of stereoregular pentads (isotactic pentad) as calculated from the relevant pentad signals (peak areas) in the NMR region of branched methylene carbons (around 27.73 ppm assigned to the BBBBB isotactic sequence), with due consideration of the superposition between stereoirregular pentads and of those signals, falling in the same region, due to the α-olefin comonomer (e.g propylene derived units when present).

Determination of Isotacticity Index (Solubility in Xylene at Room Temperature, in % by Weight) for Propylene Polymers 2.5 g of polymer and 250 $cm^3$ of xylene are introduced in a glass flask equipped with a refrigerator and a magnetical stirrer. The temperature is raised in 30 minutes up to the boiling point of the solvent. The so obtained clear solution is then kept under reflux and stirring for further 30 minutes. The closed flask is then kept for 30 minutes in a bath of ice and water and in thermostatic water bath at 25° C. for 30 minutes as well. The so formed solid is filtered on quick filtering paper. 100 $cm^3$ of the filtered liquid is poured in a previously weighed aluminum container which is heated on a heating plate under nitrogen flow, to remove the solvent by evaporation. The container is then kept in an oven at 80° C. under vacuum until constant weight is obtained. The weight percentage of polymer soluble in xylene at room temperature is then calculated.

The percent by weight of polymer insoluble in xylene at room temperature is considered the isotacticity index of the polymer. This value corresponds substantially to the isotacticity index determined by extraction with boiling n-heptane, which by definition constitutes the isotacticity index of polypropylene.

Determination of Isotacticity Index (Solubility in Xylene at Room Temperature, in % by Weight) for Butene-1 Polymers 2.5 g of polymer are dissolved in 250 ml of xylene, at 135° C., under agitation. After 20 minutes, the solution is cooled to 0° C. under stirring, and then it is allowed to settle for 30 minutes. The precipitate is filtered with filter paper; the solution is evaporated under a nitrogen current, and the residue dried under vacuum at 140° C. until constant weight. The weight percentage of polymer soluble in xylene at 0° C. is then calculated. The percent by weight of polymer insoluble in xylene at room temperature is considered the isotactic index of the polymer.

MWD Determination

The samples are prepared at a concentration of 70 mg/50 ml of stabilized 1,2,4 trichlorobenzene (250 μg/ml BHT (CAS REGISTRY NUMBER 128-37-0); the samples are then heated to 170° C. for 2.5 hours to solubilize; the measurements are run on a Waters GPCV2000 at 145° C. at a flow rate of 1.0 ml/min. using the same stabilized solvent; three Polymer Lab columns are used in series (Plgel, 20 nm mixed ALS, 300×7.5 mm).

Melting Temperature and Fusion Enthalpy

Determined by DSC according ISO 11357, part 3 with a heating rate of 20 K per minute.

Determination of X-Ray Crystallinity

The X-ray crystallinity is measured with an X-ray Diffraction Powder Diffractometer using the Cu-Kα1 radiation with fixed slits and collecting spectra between diffraction angle 2Θ=5° and 2Θ=35° with step of 0.1° every 6 seconds.

Measurement are performed on compression molded specimens in the form of disks of about 1.5-2.5 mm of thickness and 2.5-4.0 cm of diameter. These specimens are obtained in a compression molding press at a temperature of 200° C.±5° C. without any appreciable applied pressure for 10 minutes. Then applying a pressure of about 10 $Kg/cm^2$ for about few second and repeating this last operation for 3 times.

The diffraction pattern is used to derive all the components necessary for the degree of cristallinity by defining a suitable linear baseline for the whole spectrum and calculating the total area (Ta), expressed in counts/sec·2Θ, between the spectrum profile and the baseline.

Then a suitable amorphous profile is defined, along the whole spectrum, that separate, according to the two phase model, the amorphous regions from the crystalline ones. Thus it is possible to calculate the amorphous area (Aa), expressed in counts/sec·2Θ, as the area between the amorphous profile and the baseline; and the crystalline area (Ca), expressed in counts/sec·2Θ, as $$Ca=Ta-Aa$$

The degree of cristallinity of the sample is then calculated according to the formula:

$$\%\ Cr=100\times Ca/Ta$$

Creep Resistance

Test specimens having length of 200 mm and width of 5 mm are cut from the precursor tapes. After conditioning for 7 days at 23° C., the specimens are subjected to traction with the applied stress as specified hereinafter for each example. A constant load traction apparatus is used; the distance between clamps is of 50 mm. The elongation after three increasing times is measured: the smaller the three elongation values and the difference among them, the higher is the creep resistance.

EXAMPLES 1 TO 4 AND COMPARISON EXAMPLES 1 AND 2

The following materials are used as components A) and B).

Component A)

PP-1: Propylene copolymer with MFR of 2 g/10 min., containing 6% by weight of ethylene, having melting temperature of 129.8° C. and an amount of fraction insoluble in xylene at room temperature of 85%;

PP-2: Propylene copolymer with MFR of 1 g/10 min., containing 4% by weight of ethylene and 6% by weight of butene-1, having melting temperature of 132° C. and an amount of fraction insoluble in xylene at room temperature of 70%;

PP-3: Propylene homopolymer with MFR of 2 g/10 min;

Component B)

Heco: heterophasic polyolefin composition having a MFR value of about 0.6 g/10 min., flexural modulus of 20 MPa and a content of fraction soluble in xylene at room temperature of 76% by weight, and comprising (weight percentages) 17% of a crystalline copolymer of propylene with 3.3% of ethylene, and 83% of an elastomeric fraction of propylene with ethylene containing 32% of ethylene.

PB-1: butene-1/propylene copolymer containing 4.1% by weight of propylene ($^{13}$C-NMR), having MFR of 0.5 g/10 min., density of 0.886 g/cm$^3$, Flexural modulus (ISO 178) of 23.7 MPa, X-ray crystallinity of 25%, DSC TmII of 96° C., mmmm of 51.3, Mw/Mn of 6.4.

The said Heco is obtained by sequential polymerization in the presence of a Ziegler-Natta catalyst, as described above.

The said components A) and B) are melt-blended in an extruder TR 14/24D USF B.V.O (MAC GI XIV), with screw diameter of 14 mm and screw length/diameter ratio of 24:1, under the following conditions:

extrusion temperature of 210-220° C.;

screw rotation speed of 60 rpm.

All the polyolefin materials used for preparing the filaments, be them a single polymer or a composition prepared as above described, are extruded in a Plasticizers MKII extruder equipped with a flat extrusion die, with die opening width and height of 80 mm and 250 nm respectively, thus obtaining a precursor tape.

The main extrusion conditions are:

Melt temperature of 250° C.;

Screw speed of 40 rpm;

Melt pressure as reported in following Table I;

Output of about 1 kg/hour.

After cooling at room temperature through chill rolls, the precursor tape is heated by feeding it through hot rolls having a temperature of about 70° C. and drawn by feeding it through rolls with different rotation speeds. A draw ratio of 4 is obtained.

The cutting treatment is not carried out, as it is not required for testing the final properties.

Such cutting treatment is required in practice to obtain filaments having the desired width and consequently the desired titre, which in the present case could for instance range from 2 to 15 mm and from 300 to 2000 dTex respectively, but does not affect the tested properties.

The final properties of the so obtained precursor tape, measured after at least 7 days from extrusion, are reported in Table I, together with the relative amounts of the polyolefin components. Table II reports the creep resistance measurements on the precursor tapes of Example 1 and Comparison Example 1.

TABLE I

| | Example No. | | | | | |
|---|---|---|---|---|---|---|
| | 1 | 2 | 3 | 4 | Comp. 1 | Comp. 2 |
| PP-1 (wt %) | 100 | 80 | | | | |
| PP-2 (wt %) | | | 100 | 80 | | |
| PP-3 (wt %) | | | | | 100 | 80 |
| Heco (wt %) | | | | 20 | | 20 |
| PB-1 (wt %) | | 20 | | | | |
| Conditions and Properties | | | | | | |
| Melt pressure (bar) | 132 | 133 | 158 | 172 | 139 | 145 |
| Tape thickness (μm) | 72 | 80 | 72 | 74 | 78 | 83 |
| Tear resistance (N/mm) | 173 | 118.9 | 162.9 | 186.4 | 0.96 | 9.1 |
| Stress at break (MPa) | 96.3 | 85.6 | 97.7 | 107.5 | 114 | 112.2 |
| Elongation at break (%) | 105 | 150 | 144 | 165 | 62 | 152 |
| Tangent modulus (MPa) | 656 | 363 | 629 | 490 | 1625 | 972 |

TABLE II

| Example No. | 1 | Comp. 1 |
|---|---|---|
| PP-1 (wt %) | 100 | |
| PP-3 (wt %) | | 100 |
| Draw ratio | 4 | 4 |
| Applied stress (MPa) | 50 | 70 |
| Elongation (%) | | |
| after 1 hour | 24 | 64 |
| after 3 hours | — | 100 |
| after 96 hours | 102 | 200 |

EXAMPLES 5 TO 10 AND COMPARISON EXAMPLE 3

Precursor tapes are prepared as in the preceding examples, with the draw ratios specified in the following Tables III and IV.

The following materials are used as components A) and B$^I$).

Component A)

PP-1: As previously specified;

PP-3: As previously specified;

PP-4: Propylene copolymer with MFR of 1.5 g/10 min., containing 1.5% by weight of hexene-1;

PP-5: Propylene copolymer with MFR of 1.6 g/10 min., containing 7% by weight of hexene-1.

Component B$^I$)

PB-2: butene-1 homopolymer having MFR of 0.4 g/10 min. and flexural modulus of 450 MPa.

The final properties of the so obtained precursor tape, measured after at least 7 days from extrusion, are reported in Tables III and IV, together with the relative amounts of the polyolefin components.

TABLE III

| Example No. | 5 | 6 | 7 | 8 |
|---|---|---|---|---|
| PP-1 (wt %) | 80 | 50 | 20 | |
| PP-5 (wt %) | | | | 50 |
| PB-2 (wt %) | 20 | 50 | 80 | 50 |
| Draw ratio | 4 | 4 | 4 | 4 |
| Applied stress (MPa) | 48 | 70 | 50 | 70 |
| Elongation (%) | | | | |
| after 1 hour | 22 | 20 | 6 | 16 |
| after 3 hours | 26 | 20 | 6 | 18 |
| after 96 hours | 42 | 26 | 6 | 22 |
| Stress at yield (MPa) | 120 | — | — | — |
| Elongation at yield (%) | 33 | — | — | — |
| Stress at break (MPa) | 125 | 150 | 151 | 154 |
| Elongation at break (%) | 96 | 80 | 40 | 73 |

TABLE IV

| | Comp. 3 | 9 | 10 |
|---|---|---|---|
| PP-1 (wt %) | | | |
| PP-3 (wt %) | 100 | | |
| PP-4 (wt %) | | 100 | |
| PP-5 (wt %) | | | 100 |
| Draw ratio | 8 | 8 | 8 |
| Applied stress (MPa) | 163 | 163 | 163 |
| Elongation (%) | | | |
| after 1 hour | 6 | 6 | 8 |
| after 24 hours | | 10 | |
| after 96 hours | 20 | 14 | 14 |
| Stress at break (MPa) | 487 | 434 | 310 |
| Elongation at break (%) | 18 | 21 | 16 |

What is claimed is:

1. A polymer filament comprising a polyolefin composition, wherein the polyolefin composition comprises:

(A) 55-95 wt. % by weight, based upon the total weight of the polyolefin composition, of a copolymer (I) of propylene with at least one comonomer selected from ethylene and $C_4$-$C_{10}$ α-olefins and their combinations, said copolymer (I) having an MFR of 0.5-10 g/10 min., having a polymer fraction insoluble in xylene at room temperature of 60-90% by weight, a melting temperature equal to or greater than 120° C., and comprising units deriving from the said comonomers in a total amount of 0.5-25% by weight with respect to the total amount of all monomer units in the copolymer, provided that, in the absence of comonomer units deriving from $C_6$-$C_{10}$ α-olefins, the amount of comonomer units deriving from ethylene or $C_4$-$C_5$ α-olefins or their combinations is at least 2.5% by weight; and B) 5-45 wt. % by weight, based upon the total weight of the polyolefin composition, of a polyolefin composition having a flexural modulus equal to or less than 200 MPa, and wherein component B) is a heterophasic polyolefin composition comprising:

(i) a crystalline propylene homopolymer, copolymer of propylene or combinations thereof, wherein the copolymer of propylene contains up to 10% by weight of ethylene and/or an α-olefin comonomer, and (ii) a copolymer of ethylene and an α-olefin, wherein the copolymer of ethylene and an α-olefin, optionally, contains a diene, and wherein the copolymer of ethylene and an α-olefin contains 15% or more, based upon the total weight of the copolymer of ethylene and an α-olefin, of ethylene;

wherein the polymer filament has an elongation at break as measured by ASTM D882-02 at conditions of 25° C. and 500 mm/min of from 73% to 165%.

2. The polymer filament of claim 1, having a titre of at least 20 dTex.

3. The polymer filament of claim 1, stretched by drawing with a draw ratio from 1.5 to 10.

4. The polymer filament of claim 1, wherein component B) has at least one of the following features:

Shore D hardness of at most 50 points;

Shore A hardness of at most 90 points; and

X-ray crystallinity from 0 to 40%.

5. The polymer filament of claim 1, wherein the copolymer of ethylene and an α-olefin contains 10 to 40% by weight, of the α-olefin.

6. The polymer filament of claim 5, wherein the α-olefin is a $C_3$-$C_{10}$ α-olefin.

7. A manufactured item containing the polymer filaments of claim 1.

8. An artificial turf structure, comprising a plurality of polymer filaments according to claim 1.

* * * * *